US007950866B2

(12) United States Patent
To et al.

(10) Patent No.: US 7,950,866 B2
(45) Date of Patent: May 31, 2011

(54) RING BINDER MECHANISM WITH POLYMERIC HOUSING

(75) Inventors: Chun Yuen To, Hong Kong (CN); Jin Biao Pi, Daye (CN); Ming Hua Huang, Sui Zhou (CN)

(73) Assignee: World Wide Stationery Mfg. Co., Ltd., Hong Kong (CN)

( * ) Notice: Subject to any disclaimer, the term of this patent is extended or adjusted under 35 U.S.C. 154(b) by 0 days.

(21) Appl. No.: 11/848,959

(22) Filed: Aug. 31, 2007

(65) Prior Publication Data

US 2009/0060630 A1 Mar. 5, 2009

(51) Int. Cl.

| | |
|---|---|
| ***B42F 3/20*** | (2006.01) |
| ***B42F 3/02*** | (2006.01) |
| ***B42F 13/02*** | (2006.01) |
| ***B42F 13/00*** | (2006.01) |
| ***B42F 13/30*** | (2006.01) |

(52) U.S. Cl. ..... 402/31; 402/19; 402/20; 402/26; 402/36; 402/37; 402/39; 402/46

(58) Field of Classification Search ..... 402/19, 402/20, 26, 31, 36, 37, 38, 39, 40, 41, 42, 402/73, 75, 508, 46; *B42F 03/02, 03/04, B42F 13/00, 13/02, 13/12*

See application file for complete search history.

(56) References Cited

U.S. PATENT DOCUMENTS

| | | | | |
|---|---|---|---|---|
| 5,346,325 | A | 9/1994 | Yamanoi | |
| 5,879,097 | A | 3/1999 | Cheng | |
| 6,206,601 | B1 | 3/2001 | Ko | |
| 6,276,862 | B1 * | 8/2001 | Snyder et al. | 402/40 |
| 6,840,695 | B2 | 1/2005 | Horn | |
| 7,534,064 | B2 | 5/2009 | Cheng | |
| 2002/0076262 | A1 * | 6/2002 | To | 402/73 |
| 2005/0201817 | A1 | 9/2005 | Cheng | |
| 2005/0201818 | A1 | 9/2005 | Cheng | |
| 2006/0008318 | A1 * | 1/2006 | Ng | 402/19 |
| 2006/0104708 | A1 * | 5/2006 | Kaneda | 402/46 |
| 2006/0216107 | A1 | 9/2006 | Lin | |
| 2006/0228164 | A1 | 10/2006 | Horn | |
| 2006/0251468 | A1 | 11/2006 | Cheng | |
| 2007/0134054 | A1 | 6/2007 | Li | |
| 2008/0199246 | A1 | 8/2008 | To | |

OTHER PUBLICATIONS

Cyber Comfort ad sheet, Apr. 2003, 2 pgs, World Wide Stationery Mfg. Co., Ltd., Hong Kong.

Office Action dated Aug. 25, 2008 from U.S. Appl. No. 11/675,487, 9 pages. Crawford, Plastics Engineering, Third Edition, Chapter One, General Properties of Plastics, 1987, Published by Butterworth-Heinemann, 22 pages.

Kutz, Handbook of Materials Selection, Chapter 11, 2002, Published by John-Wiley & Sons, Inc., 22 pages.

* cited by examiner

*Primary Examiner* — Dana Ross
*Assistant Examiner* — Justin V Lewis
(74) *Attorney, Agent, or Firm* — Senniger Powers LLP

(57) ABSTRACT

A ring binder mechanism has a resilient polymeric housing. The housing has a central portion and lateral sides extending downwardly along either side of the central portion. A metal ring support is supported between the lateral sides for movement relative to the housing. Each of a plurality of rings includes a first ring member mounted on the ring support for movement therewith to open and close the rings. The housing applies a spring force biasing the ring support toward the open position when the first ring member is proximate its open position and biasing the ring support to the closed position when the first ring member is proximate its closed position. The housing spring force is the only spring force applied to the ring support that moves the ring support.

25 Claims, 18 Drawing Sheets

RING BINDER MECHANISM WITH POLYMERIC HOUSING

FIELD OF THE INVENTION

This invention relates to a ring binder mechanism for retaining loose-leaf pages, and in particular to a ring binder mechanism having a housing constructed at least in part from a polymeric material.

BACKGROUND

A ring binder mechanism retains loose-leaf pages, such as hole-punched pages, in a file or notebook. It has ring members for retaining the pages. The ring members may be selectively opened to add or remove pages or closed to retain pages while allowing the pages to be moved along the ring members. The ring members mount on two adjacent hinge plates that join together about a pivot axis.

A housing—typically metal and elongated—loosely supports the hinge plates within the housing and holds the hinge plates together so they may pivot relative to the housing. The housing has a generally arch-shaped cross-section, with bent-under rims that hold the hinge plates within the housing. The hinge plates are disposed within and extend across the open bottom part of the arch spaced from the top wall of the arch and the ring members extend through notches or openings in the housing.

The undeformed housing is slightly narrower than the joined hinge plates when the hinge plates are in a coplanar position (180°). So as the hinge plates pivot through this position, they deform the resilient housing laterally outwardly and cause a spring force in the housing that urges the hinge plates to pivot away from the coplanar position, either opening or closing the ring members. Thus, when the ring members are closed the spring force resists hinge plate movement and clamps the ring members together. Similarly, when the ring members are open, the spring force holds them apart. An operator may typically overcome this force by manually pulling the ring members apart or pushing them together. Levers may also be provided on one or both ends of the housing for moving the ring members between the open and closed positions.

Conventionally, the housing is mounted on the file or notebook with the open bottom part of the housing facing the file or notebook. Thus, the hinge plates are covered by the top wall of the housing. This configuration presents a generally solid metal surface as the exposed surface of the housing.

This exposed surface often has a nickel-containing plating, to which some people may be sensitive. Additionally, it is difficult and/or more costly to print on a metal surface—particularly where the metal surface is nickel-plated—in a manner that the printing is retained on the surface. Nickel plating can also present some environmental and work hazard issues.

SUMMARY OF THE INVENTION

In one aspect of the invention a ring binder mechanism for holding loose-leaf pages generally comprises an elongate housing constructed of a polymeric material. The housing has a central portion and lateral sides extending downwardly along either side of the central portion. The housing having a length. The housing is also resiliently deformable for applying a spring force. The mechanism also includes a ring support constructed of metal and disposed between the lateral sides of the polymeric housing. The ring support is supported by the polymeric housing for movement relative to the housing. The ring support has a length greater than one half the length of the housing. The mechanism also includes a plurality of rings for holding the loose-leaf pages. Each ring includes a first ring member and a second ring member. The first ring member is mounted on the ring support for movement with the ring support relative to the housing between a closed position and an open position. In the closed position the first and second ring members form a substantially continuous, closed loop for allowing loose-leaf pages retained by the rings to be moved along the rings from one ring member to the other. In the open position, the first and second ring members form a discontinuous, open loop for adding or removing loose-leaf pages from the rings. The housing biases the ring support toward the open position of the first ring member when the first ring member is proximate its open position. The housing also biases the ring support toward the closed position of the first ring member when the first ring member is proximate its closed position. The housing spring force being the only spring force applied to the ring support that moves the ring support between the open and closed positions.

In another aspect of the invention present invention a ring binder mechanism for holding loose-leaf pages generally comprises an elongated housing having a length. The housing is formed of a polymeric material and has a central portion and lateral sides extending downwardly along either side of the central portion. The mechanism also includes a ring support. The ring support includes a pair of metal hinge plates in side-by-side relation and hingedly connected to one another for pivoting movement relative to each other. The pair of hinge plates is disposed between the lateral sides of the polymeric housing and supported thereby for movement relative to the housing. The hinge plates have lengths greater than one half the length of the housing. The mechanism also includes a plurality of rings for holding the loose-leaf pages. Each ring includes a first ring member and a second ring member. The first ring member is mounted on the ring support for movement with the ring support relative to the housing between a closed position and an open position. In the closed position the first and second ring members form a substantially continuous, closed loop for allowing loose-leaf pages retained by the rings to be moved along the rings from one ring member to the other. In the open position the first and second ring members form a discontinuous, open loop for adding or removing loose-leaf pages from the rings. The housing is formed to resiliently bias the hinge plates toward the open and closed positions.

Other features will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
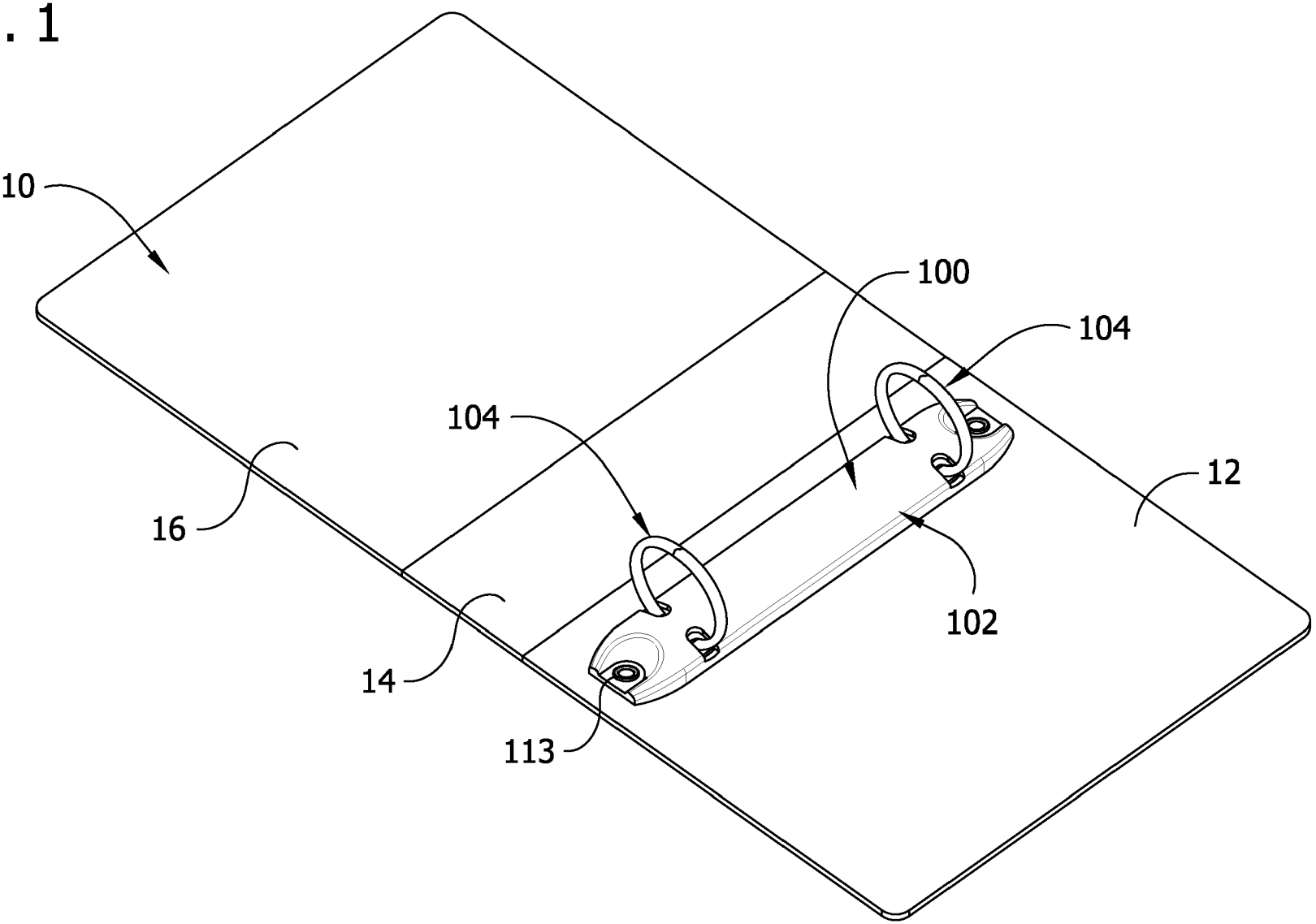
FIG. 1 is a perspective of one embodiment of a ring binder mechanism of the present invention mounted on a notebook.
Figure 2:
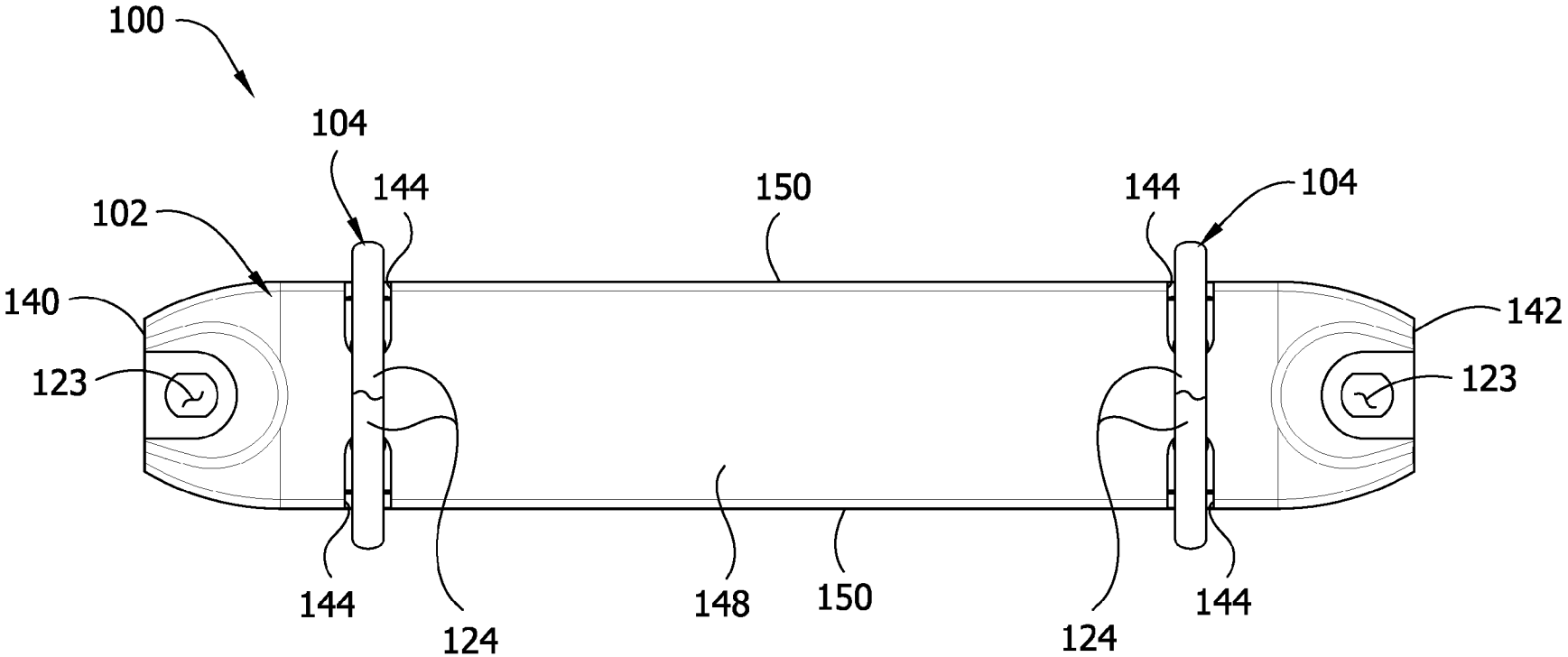
FIG. 2 is a top plan view of the ring binder mechanism shown in FIG. 1.
Figure 3:
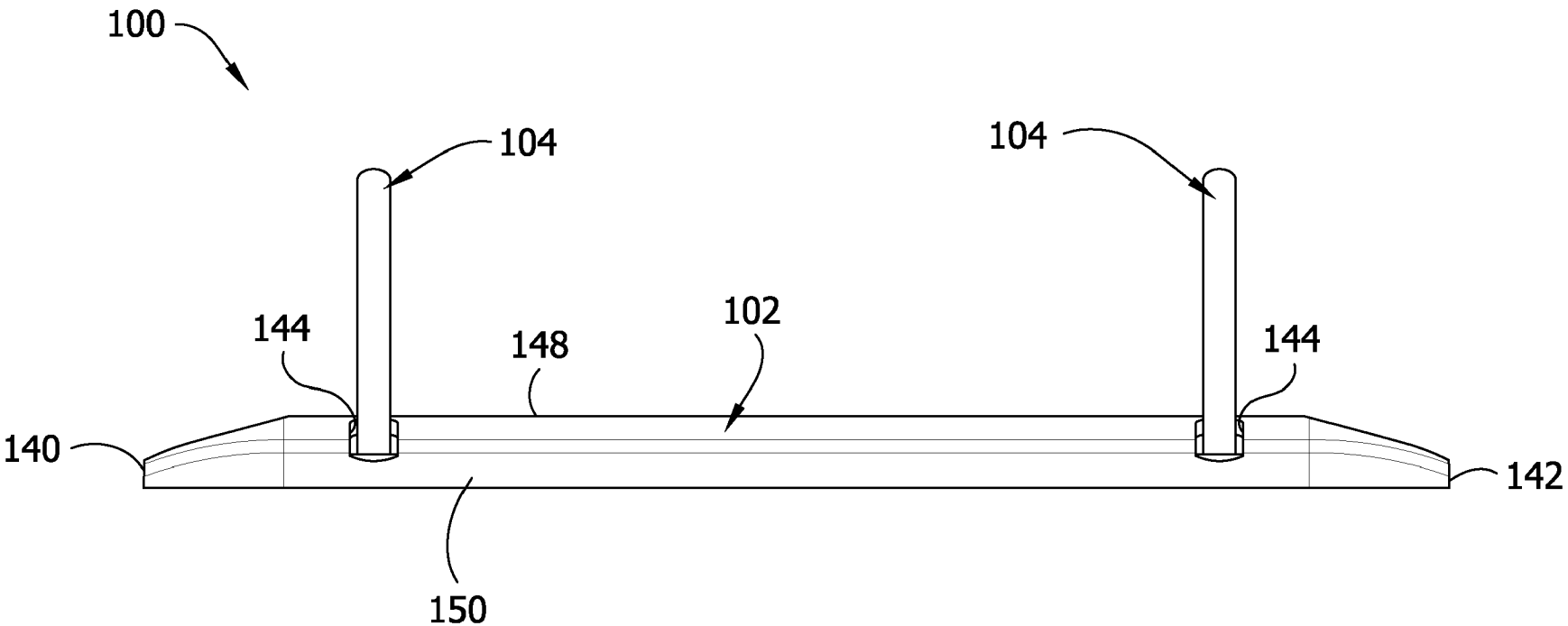
FIG. 3 is a side elevation of the ring binder mechanism shown in FIGS. 1-2.
Figure 4:
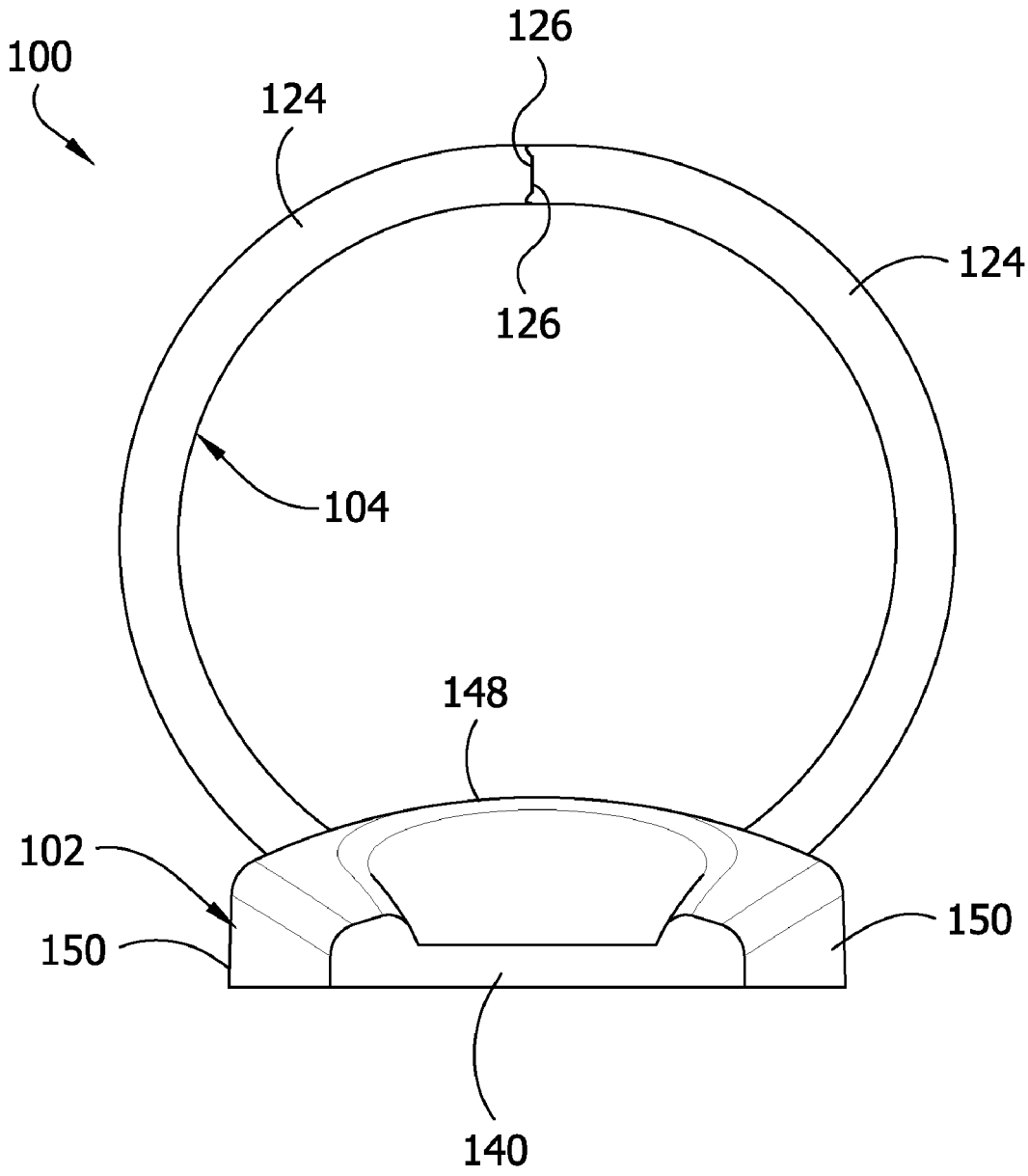
FIG. 4 is an end elevation of the ring binder mechanism shown in FIGS. 1-3.

Referring to the drawings, FIGS. 1-15 illustrate a first embodiment of a ring binder mechanism, generally indicated at 100. In FIG. 1, the mechanism 100 is shown mounted on a notebook designated generally at 10. Specifically, the mechanism 100 is shown mounted on the back cover 12 of the notebook 10 by means of rivets 113, generally adjacent to and aligned with the spine 14 of the notebook 10. The rivets 113 extend through attachment holes 123 at opposite ends of the housing 102. The front cover 16 of the notebook 10 is hingedly connected to the spine 14 and moves to selectively cover or expose loose-leaf pages (not shown) retained by the mechanism 100 in the notebook 10. Ring binder mechanisms mounted on notebooks in other ways (e.g., on the spine) or on surfaces other than a notebook (e.g., a file) do not depart from the scope of this invention. Ring binder mechanisms can also be in an unmounted state within the scope of the invention.

Figure 8:
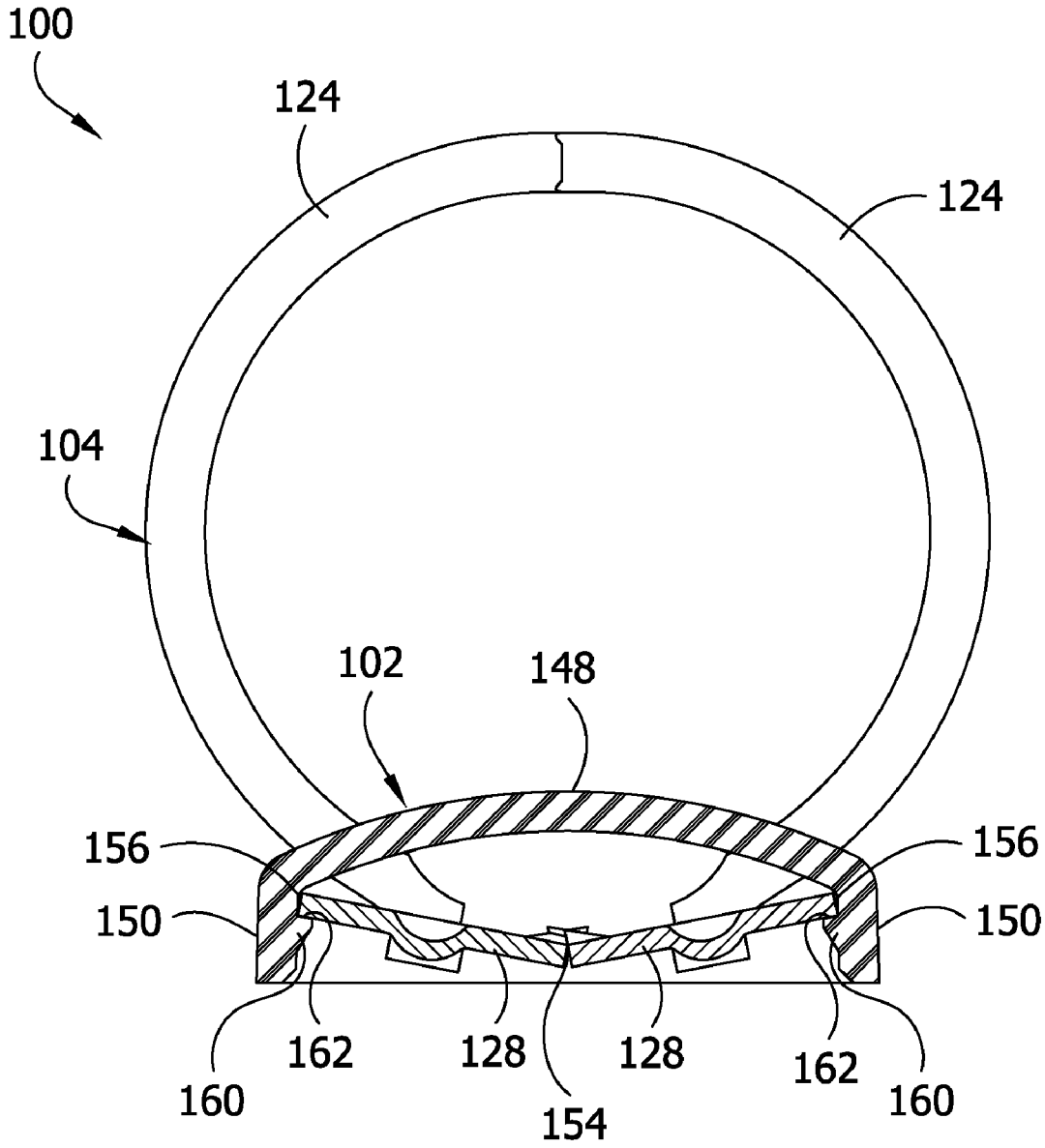
FIG. 8 is a cross section of the ring binder mechanism shown in FIGS. 1-7 taken in a plane including line 8-8 on FIG. 5.
Figure 9:
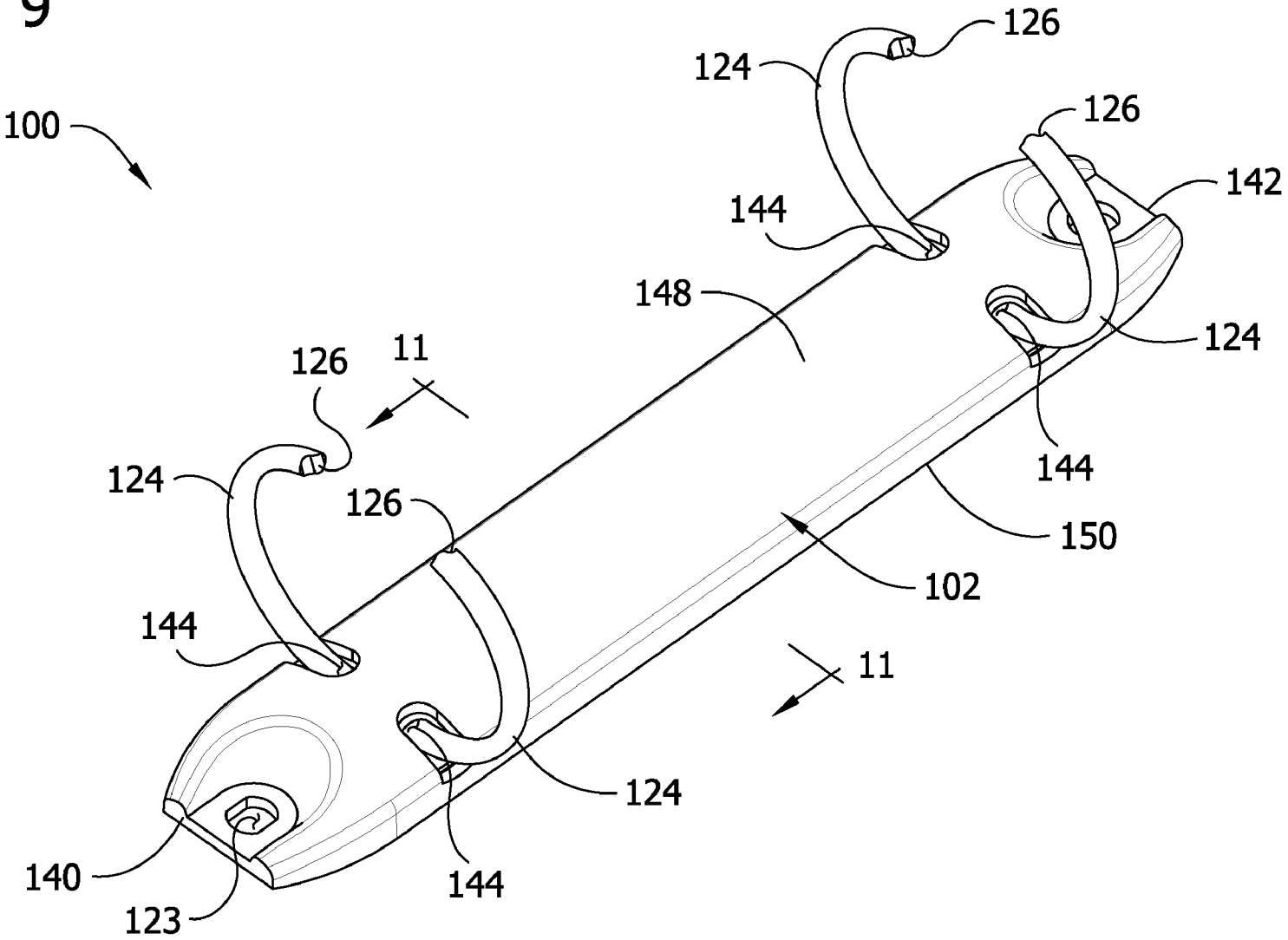
FIG. 9 is a perspective of the ring binder mechanism shown in FIGS. 1-8 showing ring members thereof in an open position.
Figure 10:
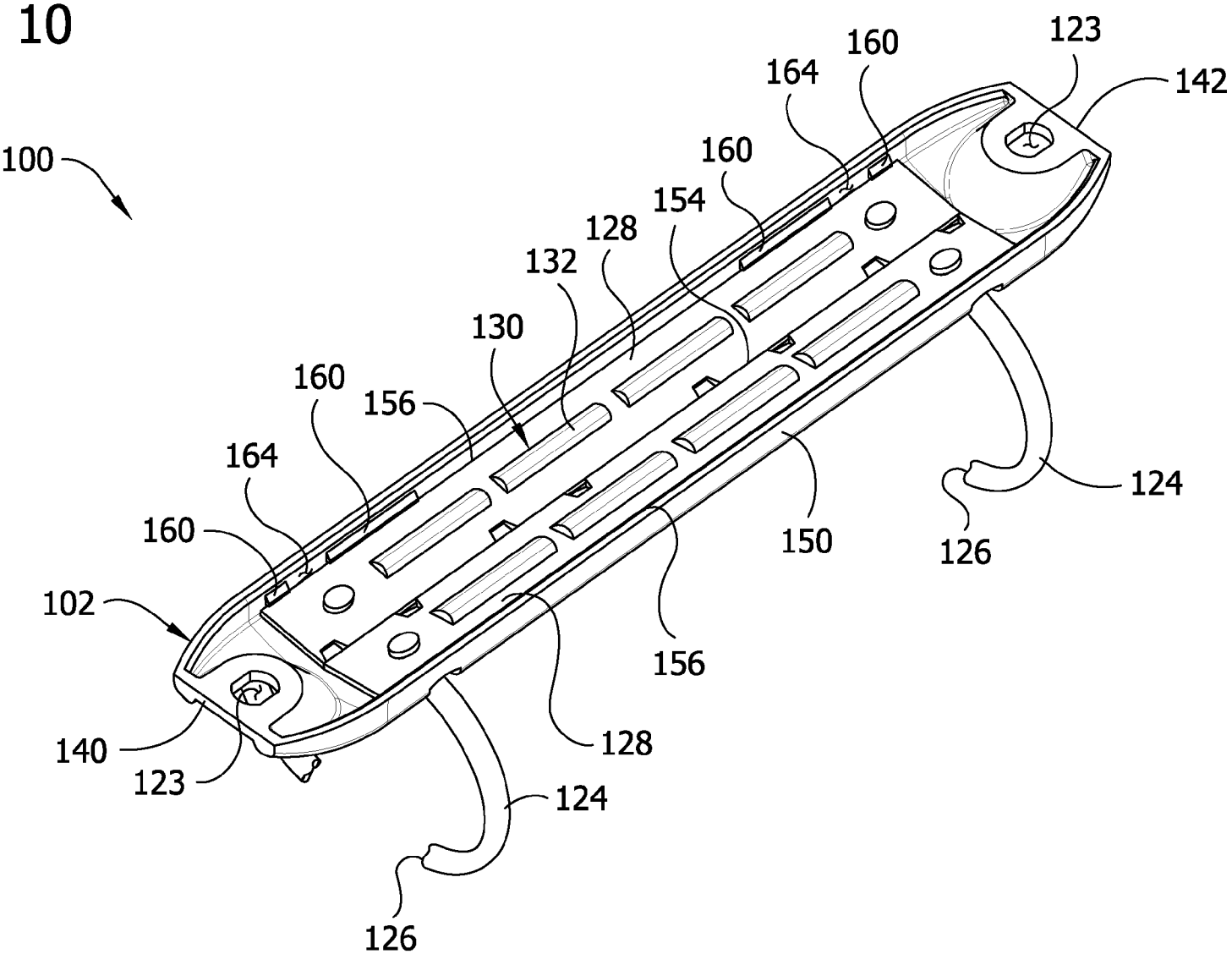
FIG. 10 is a perspective of the ring binder mechanism shown in FIGS. 1-9 illustrating the ring mechanism from a vantage point from which the bottom of the mechanism is visible while the ring members are in the open position.
Figure 11:
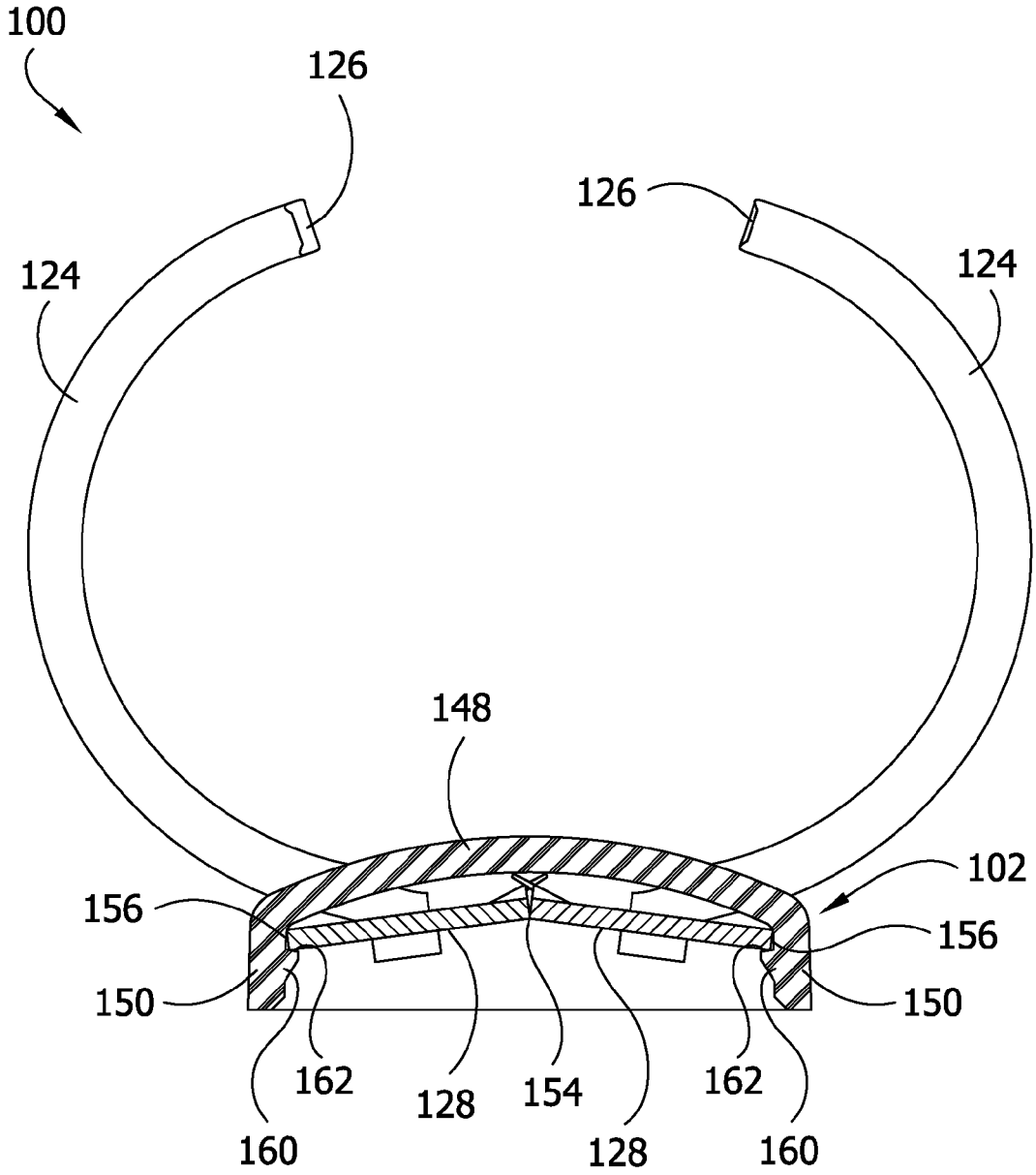
FIG. 11 is a cross section of the ring binder mechanism shown in FIGS. 1-10 taken in a plane including line 11-11 on FIG. 9 and illustrating the ring mechanism while the ring members are in the open position.

This embodiment of the mechanism 100 includes a housing, designated generally at 102, supporting a pair of hinge plates 128 (broadly a ring support) and two rings, each of which is designated generally at 104. The housing 102 is suitably has an elongate shape comprising a central portion 148 and lateral sides 150 extending downward in generally vertical planes along either side of the central portion generally between opposite longitudinal ends 140, 142 spaced the length of the housing from one another. The arrangement of the central portion 148 and lateral sides 150 results in the housing having a generally concave cross-sectional configuration between the ends 140, 142, as illustrated in FIG. 8.

The ends 140, 142 of the housing 102 are suitably closed and rounded or blunt, which reduces the likelihood that objects, such as a user's hand or clothing, will be unintentionally caught on the ends of the housing. Attachment openings 123 for the rivets 113 or other means by which the housing 102 can be secured to the notebook 10 are defined proximate the ends 140, 142 of the housing 102. Additional openings 144 are defined in the housing 102 (e.g., generally at the intersection of the lateral sides 150 and central portion 148 of the housing 102) to accommodate the rings 104 (see FIG. 2).

The housing 102 is suitably constructed of a resilient polymeric material. Acrylonitrile butadiene styrene (ABS) is one example of a suitable polymeric material in that it has been found by the present inventors to be particularly resistant to fatigue type failure and capable of retaining its spring force over numerous cycles of operation when used in construction of the housing as described herein. In one embodiment, the polymeric material has an impact strength of at least about 5 $kJ/m^2$. Because the housing 102 is constructed of a polymeric material it is readily fabricated in a variety of different colors, which is useful for color-coding notebooks. Additionally, printed text (either raised or imprinted) may be molded into or otherwise formed in the housing 102 if so desired. Further, the polymeric material does not require nickel plating (as is usually the case with metal housings for ring binders) and is therefore agreeable to people who are sensitive to nickel. The entire housing 102 is suitably molded as a single unitary piece as is the case for embodiment illustrated in the drawings. However, the housing can include non-unitary features and can be manufactured in different ways, including by being constructed in multiple pieces that are later joined together to make the housing, without departing from the scope of the invention.

Figure 13:
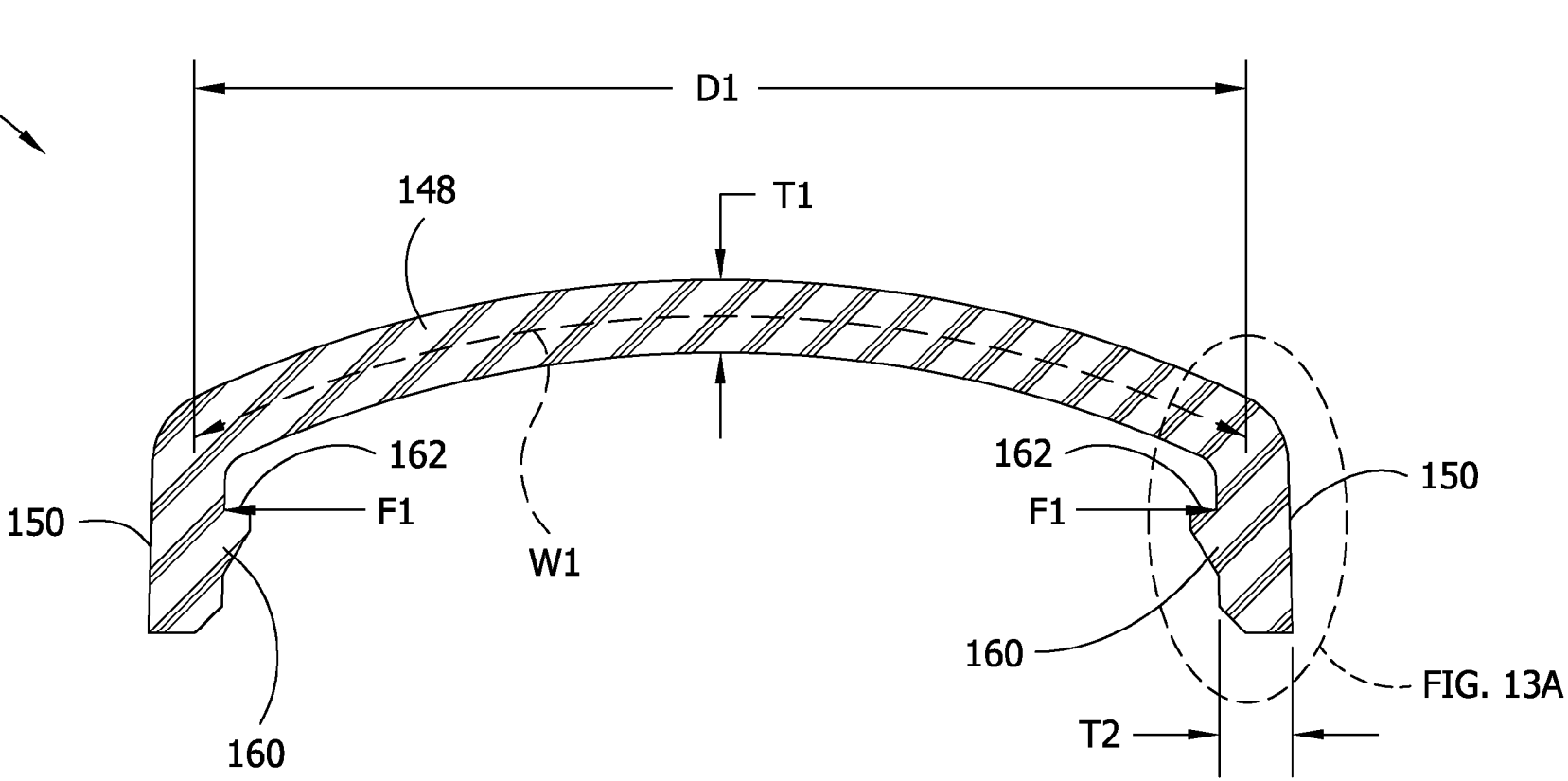
FIGS. 13-14 illustrate deformation of the housing shown in FIG. 12 cause by application of outwardly directed forces on lateral sides of the housing.
Figure 13A:
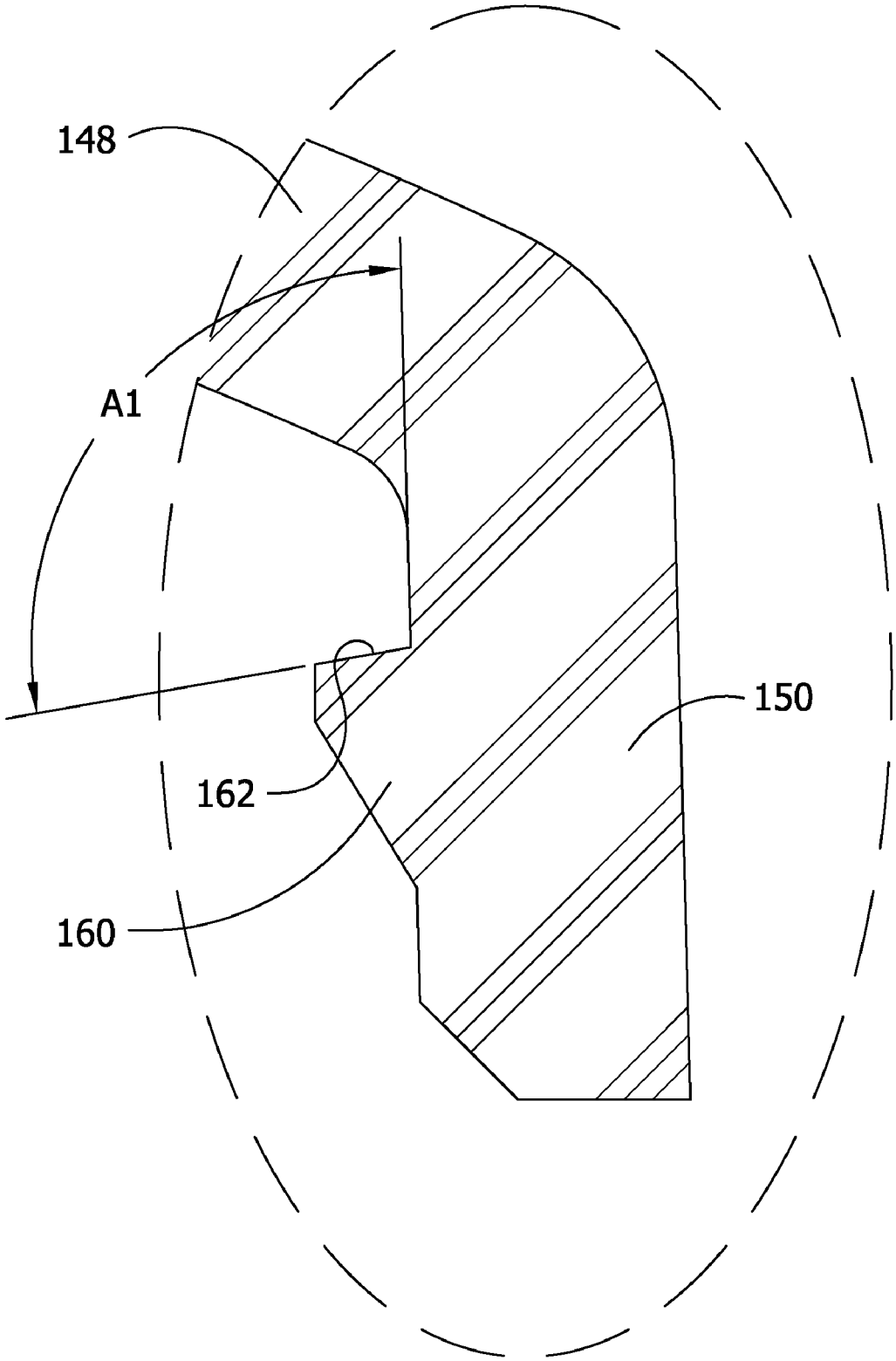
FIG. 13A is an enlarged cross section of a portion of the ring mechanism showing a hinge plate support projecting inwardly from a lateral side of the housing.

In the illustrated embodiment, the height of the housing 102 may be in the range of about 5 to 10 mm, and the width of the open bottom part of the housing may in the range of about 17 to 45 mm. In that event, the central portion 148 and lateral sides 150 of the housing 102 may have average wall thicknesses, T1 and T2 respectively, which are each in the range of about 1.2 to about 1.8 mm (FIG. 13). The average wall thickness T1 of the central portion 148 and the average wall thicknesses T2 of the lateral sides 150 are suitably about the same. In one embodiment of the invention, the wall thickness T1 and T2 of the central portion 148 and lateral sides 150 of the housing are within a range of about 1.2 to about 1.8 mm over the entirety of the central portion and lateral sides of the housing. In another embodiment, the wall thickness T1 and T2 of the central portion 148 and lateral sides 150 of the housing 102 are suitably within a range of about 1.2 to about 1.8 mm and substantially uniform over the entirety of the central portion and lateral sides of the housing.

Figure 15:
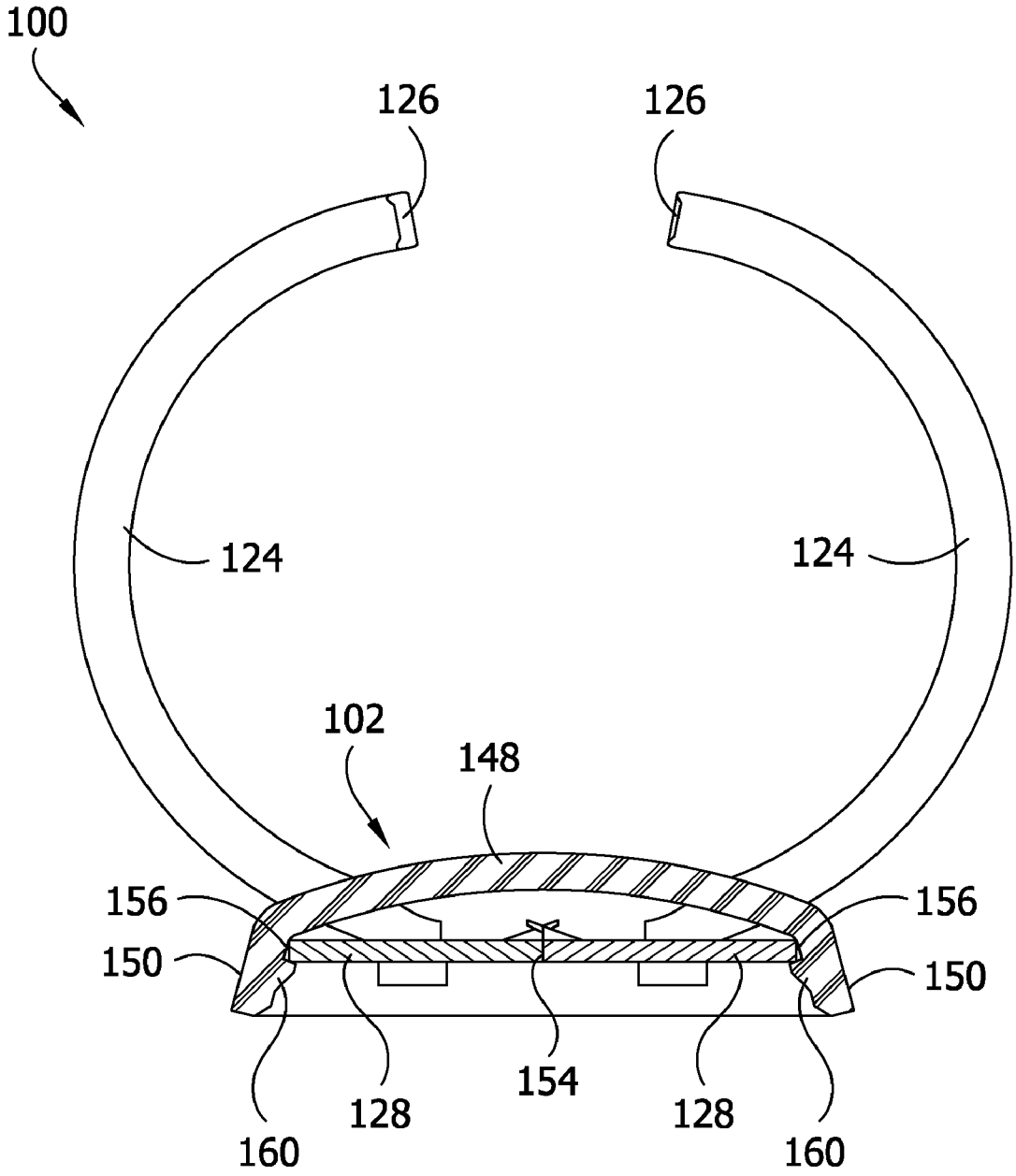
FIG. 15 is a cross section similar to FIGS. 8 and 11 showing the ring binder mechanism while the rings are at a position intermediate their open and closed positions.

The lateral sides 150 of the housing 102 in its less deformed state are spaced apart by a distance that is slightly less than the distance between the outer margins 156 of the interconnected hinge plates 128 when they are pivoted on the central hinge 154 to be coplanar with one another (e.g., as shown in FIG. 15). The housing 102 is deformed from a fully relaxed or undeformed state even in the open and closed positions so the housing continuously applies a spring force to the hinge plates 128 for holding them in the open and closed positions, respectively. The central portion 148 of the housing 102 is constructed to bend in such a way as to permit lateral movement of the lateral sides 150 of the housing apart from each other during movement of the rings 104 between their open and closed positions (FIG. 15), as will discussed in more detail below. The bending of the central portion 148 of the housing 102 spreads the deformation associated with opening and closing the rings 104 more uniformly through the housing and relatedly reduces the amount of bending type deformation that is concentrated where the lateral sides 150 join the central portion of the housing. The relatively wide distribution of the deformation through the housing 102 resulting from the bending of the central portion 148 helps the housing 102 resist fatigue type failures and plastic deformation resulting in loss of spring force over time.

Referring to FIG. 13, the central portion 148 of the illustrated embodiment has an arch-shaped configuration. Consequently, the width W1 measured along the contour of the central portion 148, i.e. the length of a path between the upper ends of the lateral sides 150 along the central portion (e.g., an arc length) is slightly longer than the distance D1 spacing the upper ends of the lateral sides 150 from one another in the undeformed state of the housing. Consequently, there is a slack length in the central portion 148 of the housing 102 equal to the difference between the lengths of W1 and D1. In one embodiment of the invention, the ratio of slack length (W1−D1) to the spacing between the lateral sides 150 (D1) at their upper ends is relatively small, e.g., suitably from about 0.8 percent to about 14 percent. For example, this ratio of slack length to spacing between the lateral sides 150 is suitably from about 1.3 percent to about 14 percent when D1 is about 17 mm, and suitably from about 0.8 percent to about 4 percent when D1 is about 45 mm. Avoiding excessive slack length in the central portion 148 of the housing 102 generally corresponds to a relatively low profile of the housing, which can facilitate an increase in the maximum number of loose-leaf pages that can be held by the rings 104 without increasing the size of the rings.

Figure 14:
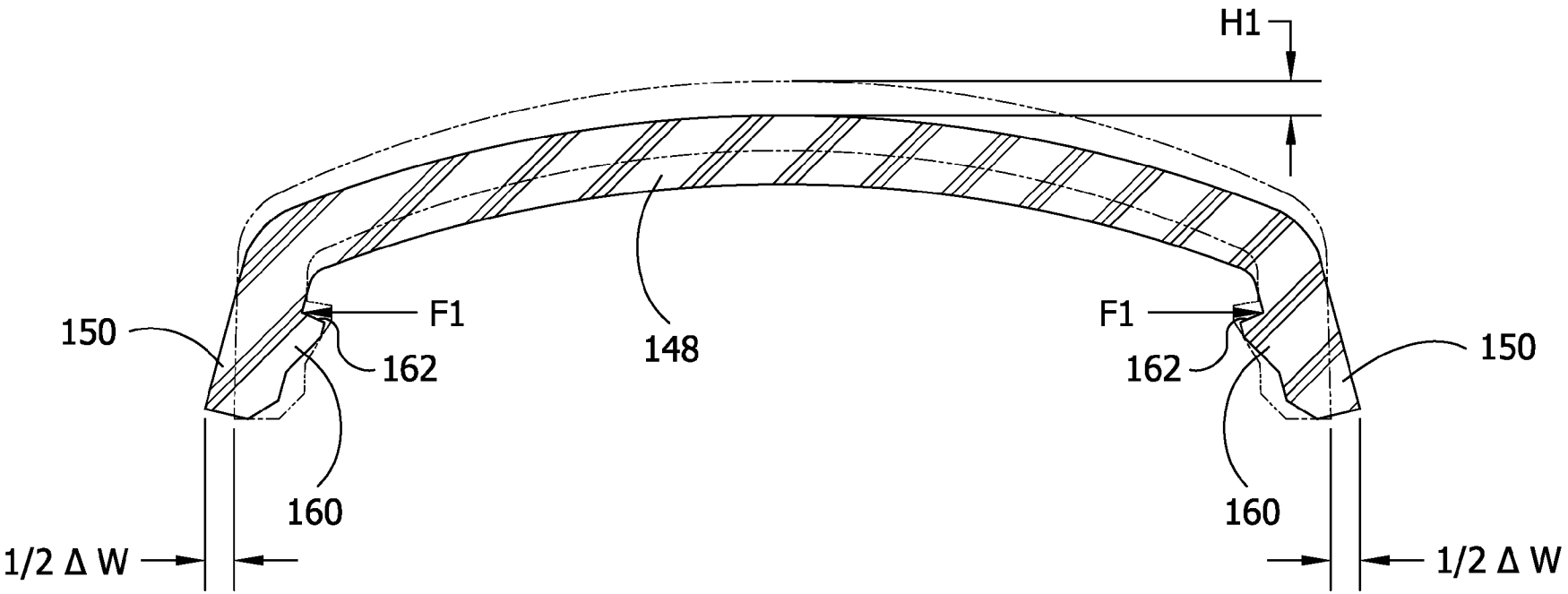

The housing 102 is designed to deform such that the spacing between the lateral sides 150 thereof increases when outwardly directed forces F1 are applied to the lateral sides, as indicated in FIGS. 13-14. In one embodiment of the invention, the housing 102 is designed so the spacing D1 between the lateral sides 150 increases an amount in the range of about 2.5 to 3.6 percent (e.g., about 0.5 to about 0.7 mm in one embodiment) in response to application of forces F1 in the range of about 226 to about 318 N (about 50 to about 70 pounds) and increases an amount in the range of about 6.1 to 7.7 percent (e.g., about 1.2 to about 1.5 mm in one embodiment) in response to application of forces F1 in the range of about 453 to about 590 N (about 100 to about 130 pounds).

The spreading of the lateral sides 150 resulting from the outwardly directed forces F1 is accompanied by a taking up of some of the slack in the central portion 148 of the housing 102. The arched central portion 148 straightens somewhat as the slack is taken up by spreading of the lateral sides 150, thereby causing the crest of the central portion of the illustrated embodiment to drop a short distance H1, as indicated in FIG. 14. In response to the outwardly directed forces F1, the resiliency of the deformed housing 102 produces inwardly directed elastic spring forces countering the outwardly directed forces via the lateral sides 150 of the housing. When the outwardly directed forces F1 are removed, the housing returns to its less deformed state. The inwardly directed spring forces applied by the respective lateral sides 150 are considered collectively as the spring force of the housing. It may also be seen that the width of the housing 102 changes by an amount ΔW as the housing deforms. In the embodiment where the height of the housing 102 is between about 5 and 10 mm, the width of the open bottom part of the housing is between about 17 and 45 mm, and the thickness of the housing is between about 1.2 and 1.8 mm, the vertical deformation of the housing H1 has been found to be between about 0.4 and 2.0 mm and the change of width W1 to be between about 0.5 and 3.5 mm.

Figure 12:
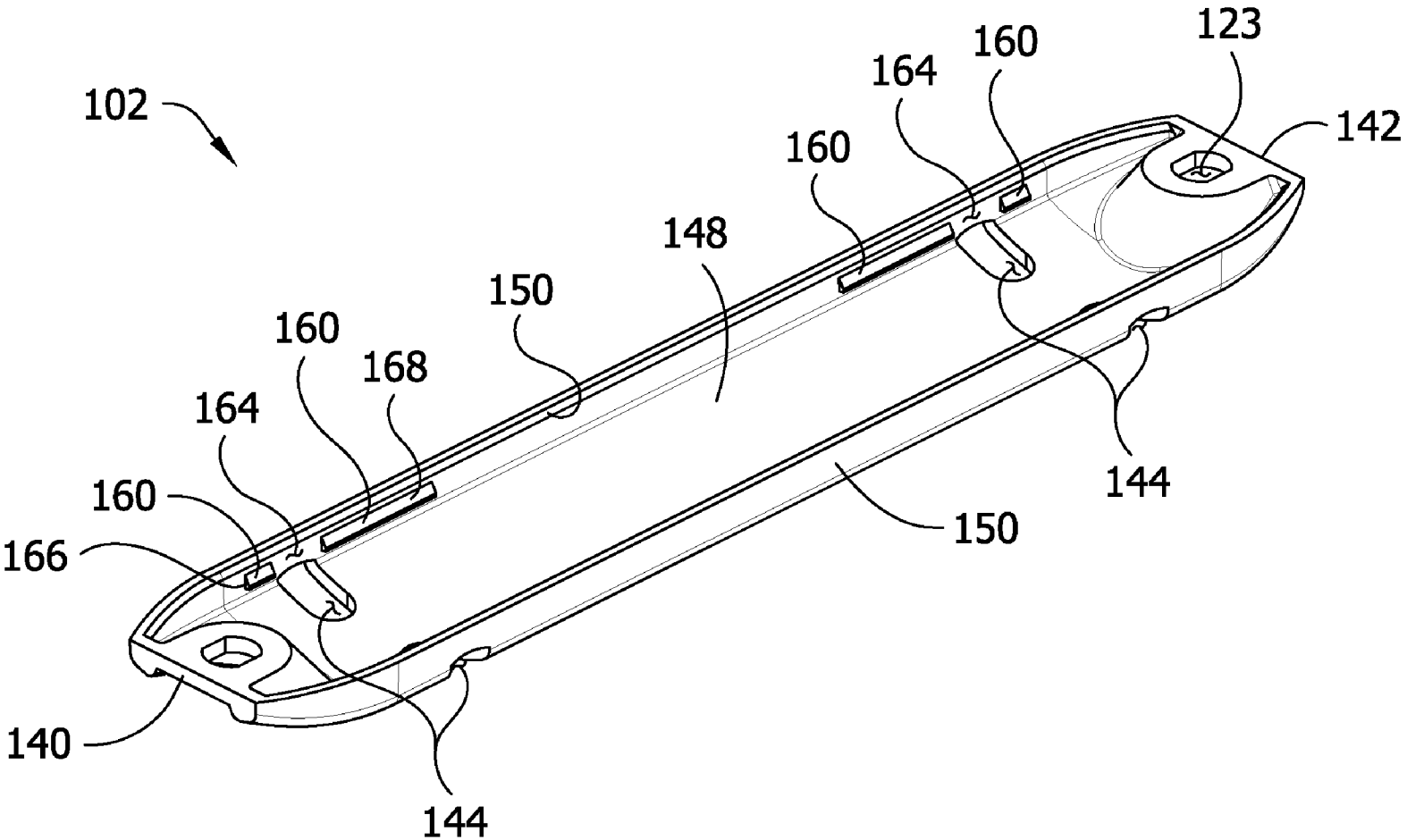
FIG. 12 is a perspective of a housing of the ring mechanism shown in FIGS. 1-11 from a vantage point from which the bottom of the housing is visible.

A plurality of hinge plate supports 160 project inwardly from the lateral sides 150 of the housing 102, as shown in FIG. 12. The hinge plate supports are suitably molded as one piece with the lateral sides 150 of the housing 102. The hinge plate supports 160 are engageable with the lateral edge margins 156 of the interconnected hinge plates 128 to retain the hinge plates in the housing 102 during operation of the ring binder mechanism 100. Referring to FIGS. 10-13A, the hinge plate supports 160 of the illustrated embodiment are wedge-shaped formations defining support surfaces 162 extending transversely inward from the lateral sides 150 of the housing. The wedge-shaped hinge plate supports 160 taper from the support surface 162 in a direction away from the central portion 148 of the housing 102. The support surfaces 162 suitably angle at least slightly downward as they project away from the lateral sides 150 of the housing in one embodiment. In this embodiment, the support surfaces 162 and lateral sides 150 form an angle A1 (FIG. 13A) that is less more than 90 degrees (e.g., about 100 degrees). It is understood that the angle A1 may be greater than 100 degrees within the scope of the invention.

Figure 6:
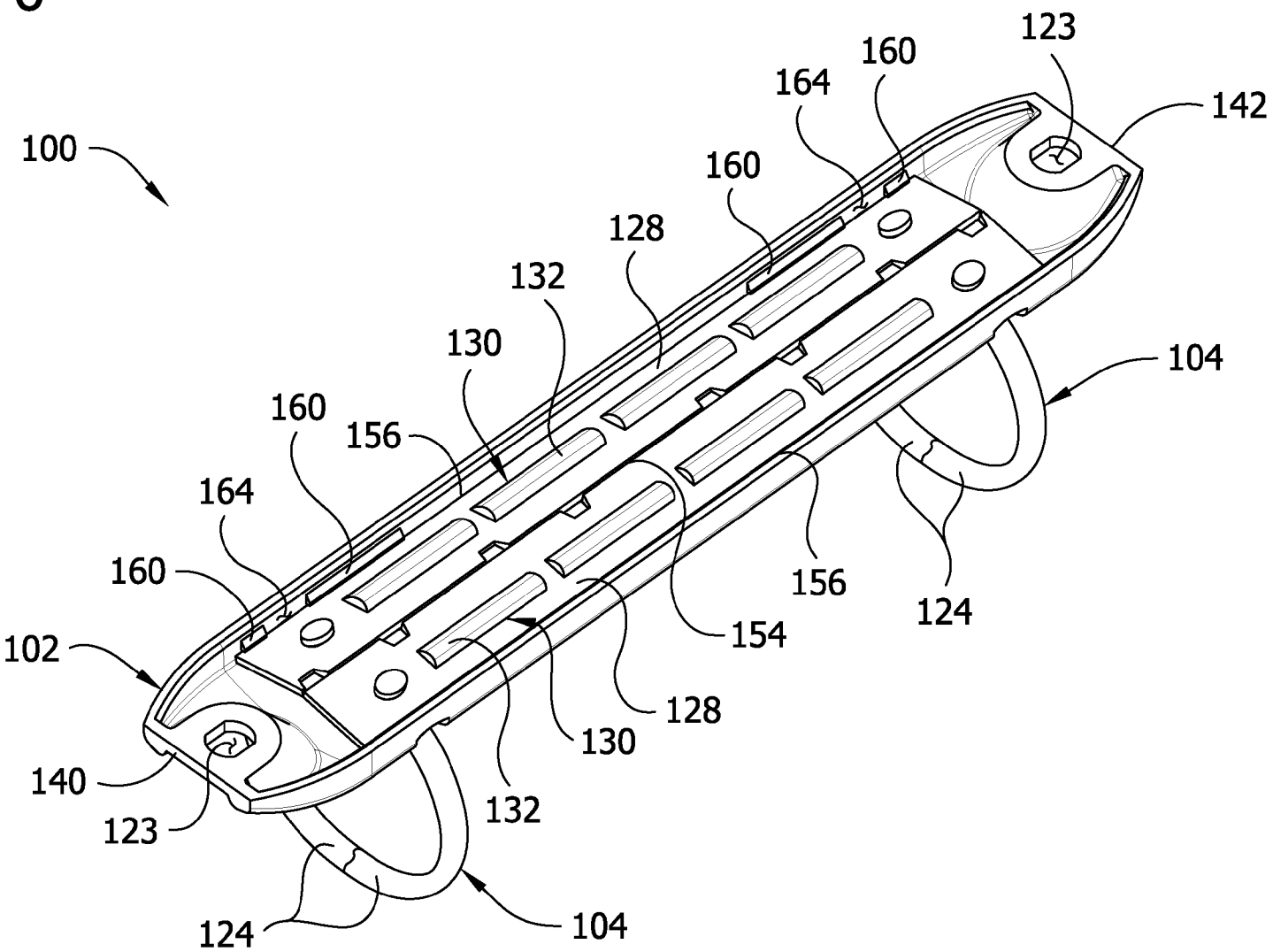
FIG. 6 is a perspective of the ring binder mechanism shown in FIGS. 1-5 from a vantage point from which the bottom of the mechanism is visible.
Figure 7:
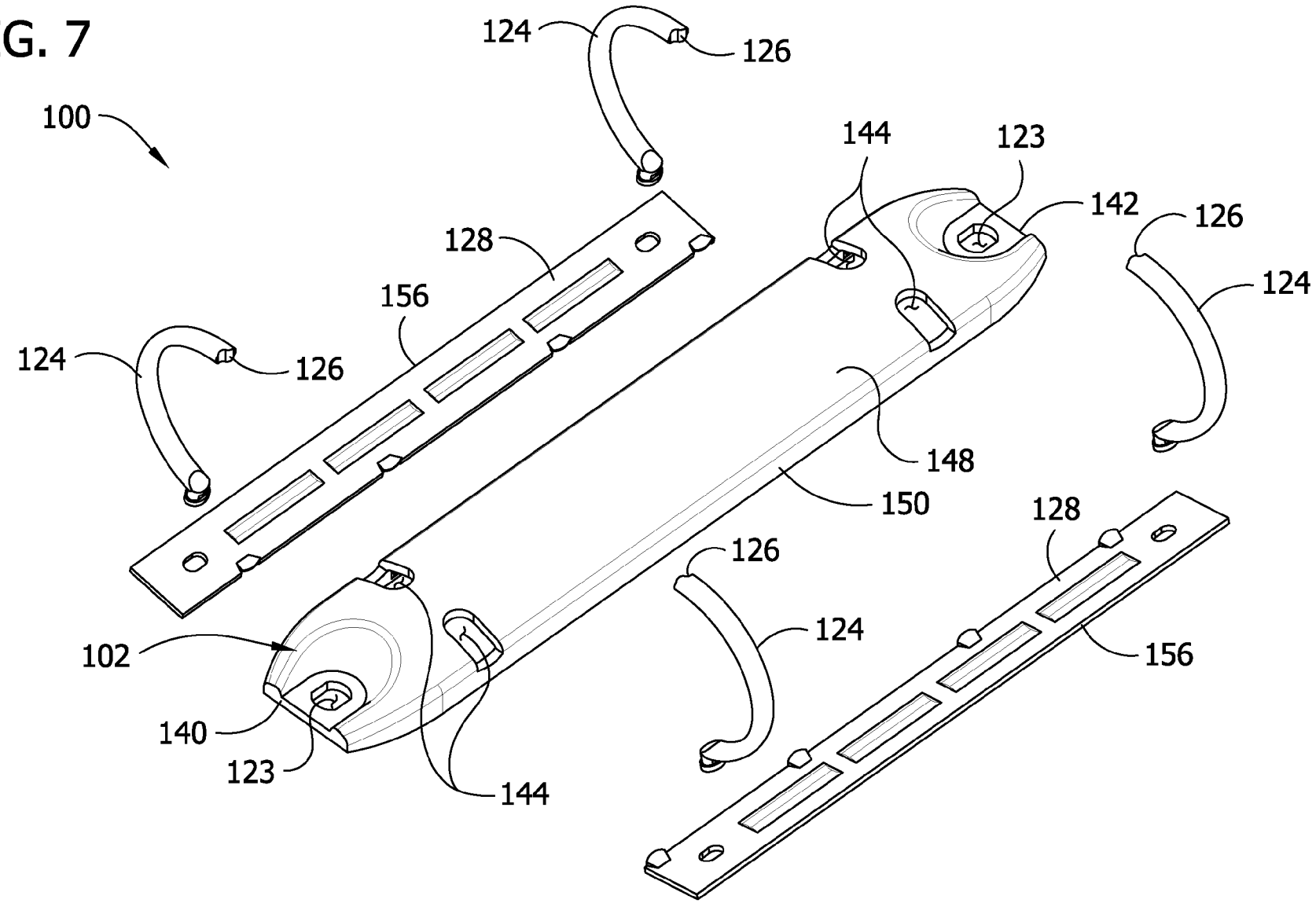
FIG. 7 is an exploded perspective view of the ring binder mechanism shown in FIGS. 1-6.

Referring to FIGS. 6 and 12, the hinge plate supports 160 of the illustrated embodiment include plural hinge plate supports on each lateral side 150 of the housing 102. Further, the hinge plate supports 160 are suitably disposed adjacent the longitudinal ends 140, 142 of the housing while central regions of the lateral sides 150 are free of hinge plate supports. Thus, the hinge plate supports 160 are located adjacent the openings 144 for the rings 104, which are also disposed generally adjacent the ends 140, 142 of the housing.

Also, in the illustrated embodiment, there is a gap 164 in coverage of the lateral sides 150 by hinge plate supports 160 aligned with the openings 144 for the rings 104 allowing the ring members 124 to pass through the gap between hinge plate supports during assembly of the ring binder mechanism 100. As shown in FIG. 12, each gap 164 is defined between a first hinge plate support 166 extending a relatively shorter distance lengthwise along the lateral sides 150 of the housing 102 and adjacent one of the longitudinal ends 140, 142 of the housing and a second hinge plate support 168 extending a relatively longer distance lengthwise along the lateral side 150 and spaced longitudinally inward of the first hinge plate support.

Figure 5:
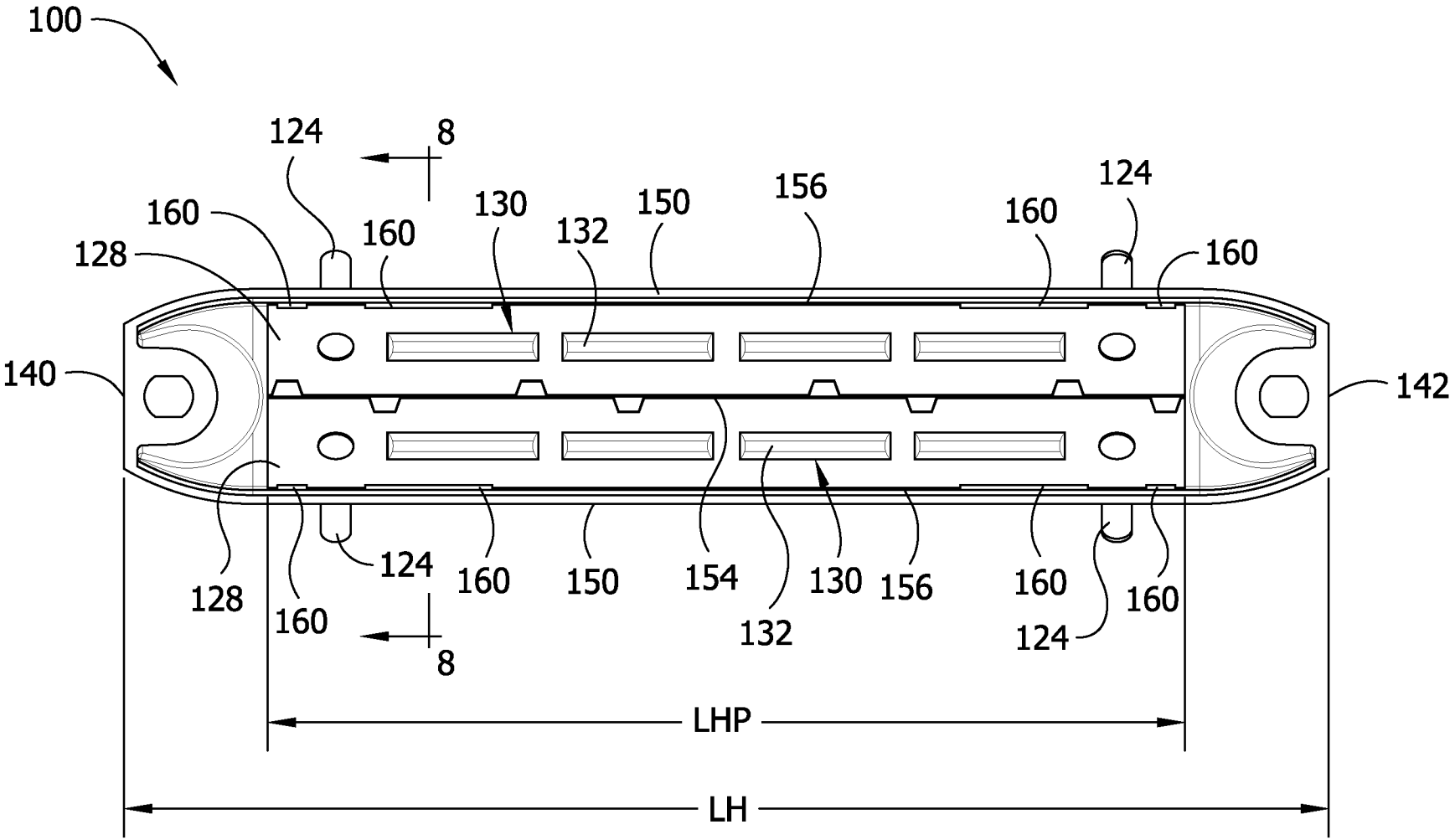
FIG. 5 is a bottom plan view of the ring binder mechanism shown in FIGS. 1-4.

As previously noted above, the ring support in this embodiment includes a pair of hinge plates 128, which are generally identical to one another except that one is rotated about 180 degrees relative to the orientation of the other. The hinge plates 128 are each generally elongate, flat, and rectangular in shape, and are each somewhat shorter in length than the housing 102, as shown in FIGS. 5-6. As shown in FIGS. 5 and 6, the hinge plates 128 are interconnected in side-by-side arrangement along their inner longitudinal margins, forming a central hinge 154 having a pivot axis for pivoting movement of the hinge plates relative to one another. This is suitably done in a conventional manner known in the art. The interconnected hinge plates 128 are disposed between the lateral sides 150 of the housing 102 such that the outer edge margins 156 of the hinge plates engage the laterals sides above the hinge plate supports 160, which retain the interconnected hinge plates 128 in the housing. As will be described, pivoting movement of the hinge plates in the housing 102 is accompanied by movement of the central hinge 154 upward and downward relative to the housing as well as pivoting movement of outer edge margins 156 of the hinge plates relative to lateral sides 150 of the housing.

The hinge plates 128 are short enough that the hinge plates do not obstruct insertion of rivets 113 into the attachment holes 123 or otherwise interfere with mounting of the ring binder mechanism 100 on the notebook 10. Although the hinge plates 128 of the illustrated embodiment are not as long as the housing 102, they suitably have a length LHP that is greater than one half the length of the housing LH (FIG. 5). The hinge plates 128 are suitably constructed of a resilient metal (e.g., steel) having a thickness in the range of about 0.6 mm to 1.6 mm. The hinge plates 128 suitably have substantially more rigidity than the housing 102. The rigidity of the hinge plates 128 facilitates efficient transfer of forces through the hinge plates (e.g., to facilitate transfer forces applied to one or more ring members to open and/or close the rings).

Each hinge plate 128 suitably has at least one rib 130 extending longitudinally thereon, suitably along a longitudinal centerline of the hinge plate. Each hinge plate 128 of the illustrated embodiment, for example, has a series of ribs 130 extending longitudinally thereon. The ribs 130 are formed in a suitable manner such as by stamping into the generally flat hinge plate 128. Although the ribs can have various shapes within the scope of the invention, the ribs 130 in the illustrated embodiment comprise generally rectangular protrusions 132 on one side of the hinge plate 128 (e.g., on the side opposite the rings 104 as in the illustrated embodiment) accompanied by similarly shaped indentations (not shown) in registration with the protrusions and on the opposite side of the hinge plate (e.g., generally facing the rings in the illustrated embodiment). The ribs 130 add additional stiffness to the hinge plates 128 to further enhance transfer of forces through the hinge plates to facilitate opening and closing of the rings 104.

The rings 104 retain loose-leaf pages (not shown) on the ring binder mechanism 100 in the notebook 10. The two rings 104 of the ring binder mechanism 100 are substantially similar and are each generally circular in shape. The rings 104 each include two generally semi-circular ring members 124 formed from a conventional, cylindrical rod of a suitable material (e.g., steel). The ring members 124 include free ends 126 that are formed to secure the ring members 124 against misalignment when they are closed together. The rings could be D-shaped as is known in the art, or shaped otherwise within the scope of this invention. Ring binder mechanisms with ring members formed of different material or having different cross-sectional shapes, for example, oval shapes, do not depart from the scope of this invention. Likewise the number of rings supported by the housing can vary within the scope of the invention.

One ring member 124 of each ring 104 is mounted on one of the interconnected hinge plates 128, while the other ring member of that ring is mounted on the opposite hinge plate. The ring members 124 extend through the openings 144 and are arranged so their free ends 126 face toward one another above the housing 102. The ring members 124 are moveable between an open position (FIGS. 9-11) in which loose-leaf pages can be added to and/or removed from the ring binder mechanism 100 and a closed position (FIGS. 1-6, 8) in which the free ends 126 of corresponding ring members 124 are joined to retain any loose-leaf pages then on the rings 104 in the binder mechanism.

In the illustrated embodiment, the ring members 124 are rigidly connected to the hinge plates 128 as is known in the art so the ring members move with the hinge plates when they pivot. Although in the illustrated ring binder mechanism 100 both ring members 124 of each ring 104 are each mounted on one of the two hinge plates 128 and move with the pivoting movement of the hinge plates 128, a mechanism in which each ring has one movable ring member and one fixed ring member does not depart from the scope of this invention (e.g., a mechanism in which only one of the ring members of each ring is mounted on a hinge plate with the other ring member mounted, for example, on the housing 102).

When the mechanism 100 is at rest, the ring members 124 and hinge plates 128 are normally at either their open or their closed position. However, the ring members 124 and hinge plates 128 are moveable between their open and closed positions (e.g., such as by a user applying a force to the ring members to open or close the rings 104). Referring to FIG. 15, as the hinge plates 128 are moved away from the open or closed position to an intermediate position, the distance between the outer edge margins 156 of the interconnected hinge plates 128 increases. Consequently, the hinge plates 128 exert outwardly directed forces on the lateral sides 150 of the housing 102, thereby causing the housing to deform to allow the lateral sides 150 to spread apart to accommodate the increased distance between the outer margins 156 of the interconnected hinge plates.

In response to deformation of the housing 102 by the interconnected hinge plates 128, the housing exerts an increased spring force that squeezes the outer edge margins of the hinge plates toward one another. This spring force biases the hinge plates 128 and the ring members 124 toward their closed positions when they are proximate their closed positions. Likewise, the spring force biases the hinge plates 128 and ring members 124 to move toward their open positions when they are proximate their open positions. As the ring members 124 and hinge plates 128 are moved between their open and closed positions, the hinge plates 128 become co-planar with one another (as illustrated in FIG. 15), the distance between outer edge margins 156 of the interconnected hinge plates 128 reaches its maximum. This is an unstable position of the hinge plates 128 as any movement of the hinge plates toward either of the open and closed positions will result in the hinge plates being biased to continue moving away from the co-planar position of the hinge plates all the way to the open or closed position.

In the illustrated embodiment, the spring force of the housing 102 is the only spring force applied to the hinge plates 128 to move the ring members 124 and hinge plates 128. Thus, no extra parts are required even though a polymeric housing is used. In one embodiment of the invention, the housing 102 is constructed to apply a spring force to the hinge plates sufficient to hold the hinge plates in their closed position until such time as a force applied to the ring members 124 of one of the rings 104 to open the rings exceeds about 22 N (5 pounds) at which time the applied force overcomes the housing spring force and causes the hinge plates and ring members to move toward their open positions. In another embodiment of the invention, the housing 102 is constructed to apply a spring force to the hinge plates 128 sufficient to hold the hinge plates in their closed position until such time as a force applied to the ring members 124 of one of the rings 104 to open the rings exceeds about 31 N (7 pounds) at which time the applied force overcomes the spring force and causes the hinge plates and ring members to move toward their open positions. In yet another embodiment of the invention, the housing 102 is constructed to apply a spring force to the hinge plates 128 sufficient to hold the hinge plates in their closed position until such time as a force applied to the ring members 124 of one of the rings 104 to open the rings exceeds about 40 N (9 pounds)

at which time the applied force overcomes the spring force and causes the hinge plates and ring members to move toward their open positions.

The housing 102 is constructed to withstand multiple opening and closing cycles of the rings 104. For instance, in one embodiment, the housing 102 is able to withstand at least about 1,000 opening and closing cycles of the rings 104 without experiencing any structural failures or substantial plastic deformation resulting in loss of spring force.

Figure 16:
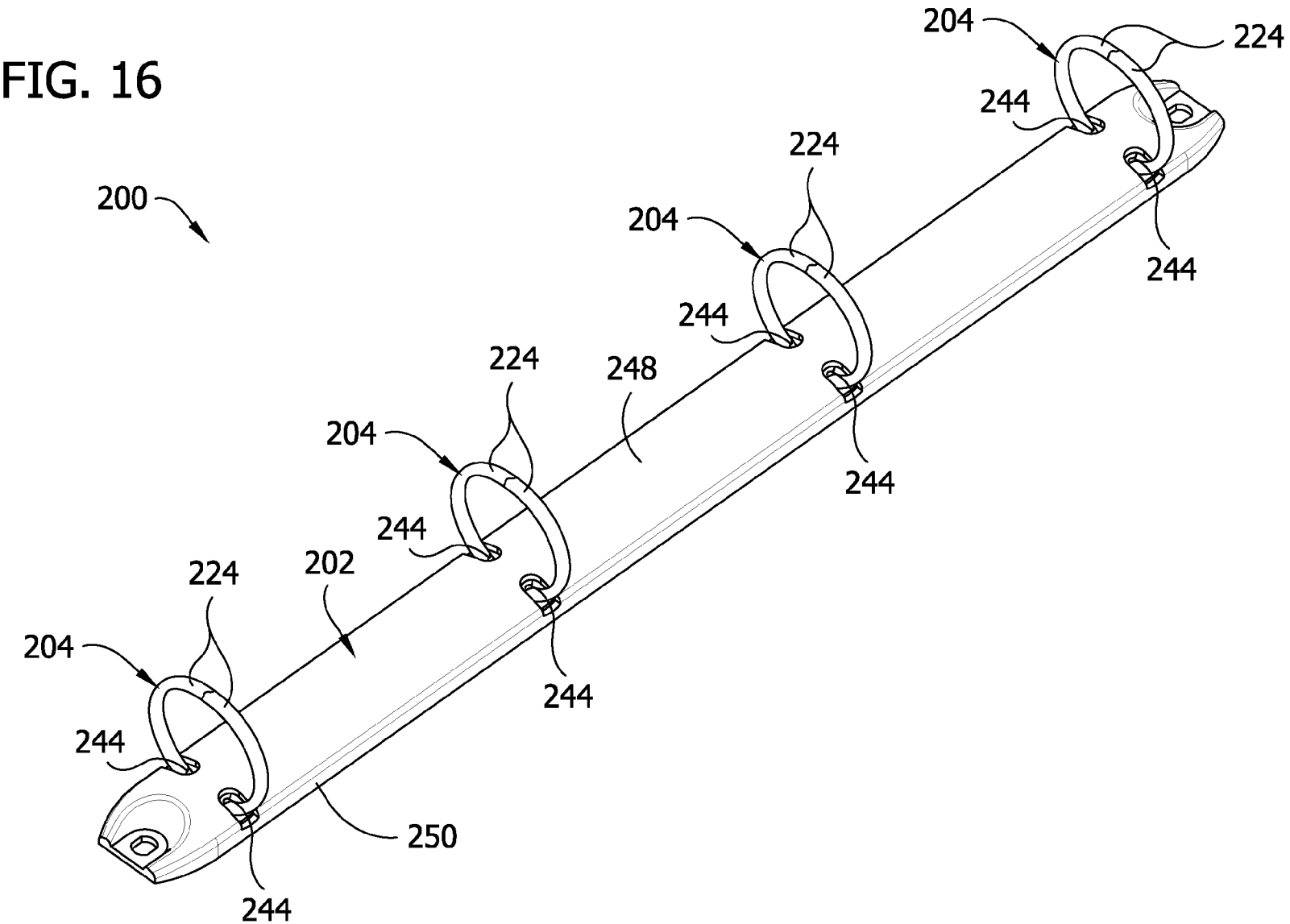
FIG. 16 is a perspective of another embodiment of a ring binder mechanism of the present invention.
Figure 17:
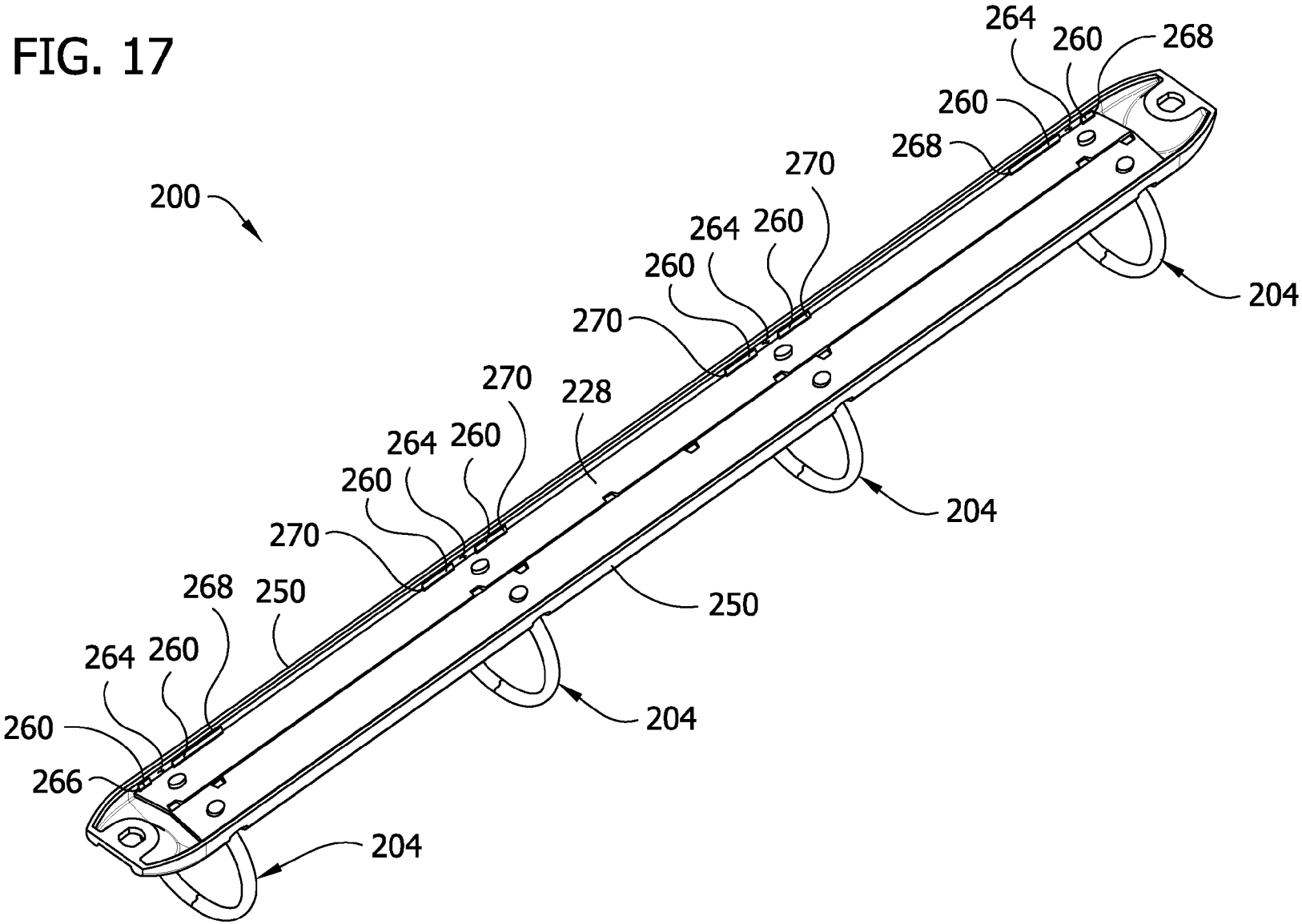
FIG. 17 is a perspective of the ring binder mechanism shown in FIG. 16 taken from a vantage point from which the bottom of the ring binder mechanism is visible.

A second embodiment of a ring binder mechanism, generally designated 200 is illustrated in FIGS. 16-17. Except as noted, this embodiment is constructed and operated in substantially the same manner as the ring binder mechanism 100 described above and illustrated in FIGS. 1-15. In contrast the mechanism 100, which is illustrated as having only two rings 104, the mechanism 200 illustrated in FIGS. 16 and 17 includes four rings 204. The housing 202 is similar to the housing 102 described above, but it has a substantially greater length (e.g., almost double) allowing the four rings 204 to be spaced lengthwise along the housing at intervals that are about equal to the spacing between the rings of the first embodiment 100. Openings 244 for each of the four rings 204 are suitably provided in the housing 202 (e.g., generally at the intersection of the central portion 248 and lateral sides 250 thereof) in the same manner as openings 144.

Referring to FIG. 17, the hinge plates 228 are substantially longer than the hinge plates 128 described above. Each hinge plate 228 has four ring members 224 mounted thereon, one for each of the rings 204. It is understood however, that two sets of interconnected hinge plates can be spaced longitudinally from one another without departing from the scope of the invention.

The hinge plate supports 260 include relatively shorter (e.g., "first" and "third") hinge plate supports 266 adjacent longitudinal ends of the housing 202 and relatively longer (e.g., "second" and "fourth") hinge plate supports 268 spaced longitudinally inward thereof, which are generally analogous to the hinge plate supports 166, 168 described above. Additional hinge plate supports 270 (e.g., having lengths intermediate the relatively shorter hinge plate supports 266 and the relatively longer hinge plate supports 268) project inward from the lateral sides 250 at central portions of the hinge plates 128. In particular, the additional hinge plate supports 270 illustrated in FIG. 17 are adjacent the ring members 224 of the two centrally disposed rings 204. Moreover, gaps 264 (which are analogous to the gaps 164 described above) for passage of rings therethrough between the hinge plate supports 260 are provided to facilitate assembly of the ring mechanism, generally as described above.

When introducing elements of the ring binder mechanisms herein, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of "upward" and "downward" and variations of these terms, or the use of other directional and orientation terms, is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for holding loose-leaf pages, the mechanism comprising:

an elongate housing constructed of a polymeric material and having a central portion and lateral sides extending downwardly along either side of the central portion, the housing having a length and being resiliently deformable for applying a spring force;

a ring support constructed of metal and disposed between the lateral sides of the polymeric housing and supported thereby for movement relative to the housing, the ring support having a length greater than one half the length of the housing; and a plurality of rings for holding the loose-leaf pages, each ring including a first ring member and a second ring member, the first ring member being mounted on the ring support for movement with the ring support relative to the housing between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings, the housing spring force biasing the ring support toward the open position of the first ring member when it is proximate its open position and biasing the ring support toward the closed position of the first ring member when it is proximate its closed position, the housing spring force being the only spring force applied to the ring support that moves the ring support.

2. A ring binder mechanism as set forth in claim 1 wherein the polymeric material comprises acrylonitrile butadiene styrene (ABS).

3. A ring binder mechanism as set forth in claim 2 wherein the wall thickness of the housing is about 1.2 to 1.8 mm.

4. A ring mechanism as set forth in claim 3 wherein the wall thickness of the housing is substantially uniform over the entirety of the central portion and lateral sides of the housing.

5. A ring binder mechanism as set forth in claim 1 wherein the housing is constructed to apply a spring force to the ring support for holding the ring support in the closed position until a force applied to the ring members of one of the rings exceeds about 22 N (5 pounds) at which time the ring support moves to the open position.

6. A ring binder mechanism as set forth in claim 1, wherein the ring support comprises a pair of metal hinge plates in generally side-by-side relation and hingedly connected to one another for pivoting movement relative to each other.

7. A ring binder mechanism as set forth in 6 wherein the housing comprises hinge plate supports projecting inwardly from the lateral sides of the housing and engageable with lateral edge margins of the hinge plates for retaining the hinge plates in the housing.

8. A ring binder mechanism as set forth in claim 7 wherein there are plural hinge plate supports on each lateral side of the housing.

9. A ring binder mechanism as set forth in claim 7 wherein the housing has openings, the first and second ring members extend through the openings, and the hinge plate supports are disposed on opposite sides of the openings.

10. A ring binder mechanism as set forth in claim 6 wherein each of the metal hinge plates is formed with at least one rib.

11. A ring binder mechanism as set forth in claim 1 in combination with a cover, the ring binder mechanism being mounted on the cover, the cover being hinged for movement to selectively cover and expose any loose leaf pages held by the ring binder mechanism.

12. A ring binder mechanism as set forth in claim 1 wherein the polymeric material has an impact strength of at least about 5 kJ/m$^2$.

13. A ring binder mechanism for holding loose-leaf pages, the mechanism comprising:

an elongate housing having a length and being formed of a polymeric material, the housing having a central portion and lateral sides extending downwardly along either side of the central portion;

a ring support comprising a pair of metal hinge plates in side-by-side relation and hingedly connected to one another for pivoting movement relative to each other, the pair of hinge plates being disposed between the lateral sides of the polymeric housing and supported thereby for movement relative to the housing, the hinge plates having edge margins that engage the lateral sides of the polymeric housing, the hinge plates having lengths greater than one half the length of the housing; and a plurality of rings for holding the loose-leaf pages, each ring including a first ring member and a second ring member, the first ring member being mounted on the ring support for movement with the ring support relative to the housing between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings, the housing being formed to resiliently bias the hinge plates toward the open and closed positions.

14. A ring binder mechanism as set forth in 13 wherein the housing comprises hinge plate supports projecting inwardly from the lateral sides of the housing and engageable with lateral edge margins of the hinge plates for retaining the hinge plates in the housing.

15. A ring binder mechanism as set forth in claim 14 wherein the hinge plate supports each define a support surface extending transversely of the housing from the lateral side thereof.

16. A ring binder mechanism as set forth in claim 14 wherein the hinge plate supports are molded as one piece of polymeric material with the housing.

17. A ring binder mechanism as set forth in claim 16 wherein there are plural hinge plate supports on each lateral side of the housing.

18. A ring binder mechanism as set forth in claim 14 wherein the housing has openings, the first and second ring members extending through the openings, hinge plate supports being disposed on opposite sides of the openings.

19. A ring binder mechanism as set forth in claim 13 wherein each of the metal hinge plates is formed with at least one rib.

20. A ring binder mechanism as set forth in claim 13 wherein the mechanism is free of springs apart from the housing for resiliently biasing the hinge plates toward the open and closed positions.

21. A ring binder mechanism as set forth in claim 13 wherein the polymeric material comprises acrylonitrile butadiene styrene (ABS).

22. A ring binder mechanism as set forth in claim 21 wherein the wall thickness of the housing is about 1.2 to 1.8 mm.

23. A ring binder mechanism as set forth in claim 13 wherein the housing is constructed to apply a spring force to the hinge plates for holding the hinge plates in the closed position until a force applied to the ring members of one of the rings exceeds about 22 N (5 pounds) at which time the hinge plates pivot to the open position.

24. The ring binder mechanism as set forth in claim 13 in combination with a cover, the ring binder mechanism being mounted on the cover, the cover being hinged for movement to selectively cover and expose any loose leaf pages held by the ring binder mechanism.

25. A ring binder mechanism as set forth in claim 13 wherein the polymeric material has an impact strength of at least about 5 kJ/m$^2$.

* * * * *